United States Patent [19]

Rawlins

[11] Patent Number: 4,675,936

[45] Date of Patent: Jun. 30, 1987

[54] LIQUID ASPIRATOR VACUUM ATTACHMENT

[76] Inventor: Mark W. Rawlins, 661 East 15th Avenue, Vancouver, B.C., Canada, V5T2R6

[21] Appl. No.: 801,231

[22] Filed: Nov. 25, 1985

[30] Foreign Application Priority Data

Jan. 16, 1985 [CA] Canada ..... 472148

[51] Int. Cl.[4] ..... H47L 9/20

[52] U.S. Cl. ..... 15/353

[58] Field of Search ..... 15/320, 344, 352, 353

[56] References Cited

U.S. PATENT DOCUMENTS

| | | | |
|---|---|---|---|
| 2,635,277 | 4/1953 | Belknap | 15/322 |
| 4,287,636 | 9/1981 | Brazier | 15/328 |
| 4,536,914 | 8/1985 | Levine | 15/344 |

*Primary Examiner*—Ronald Feldbaum

*Attorney, Agent, or Firm*—Allan M. Shapiro

[57] ABSTRACT

The use of liquid aspirators which are connected to conventional vacuum cleaners is known. In this invention the body exists of two separate body parts which are held together by a filter cartridge. The said rear body piece is provided with an extended tube in which a hose from a conventional vacuum cleaner inserts. Also said rear body piece holds a cartridge containing a filter and filter support where liquid is filtered through. The front said body piece acts as the liquid reservoir and is provided with a tube connected to the front nozzle of said body part extending along the top of said body part and protruding through the filter cartridge to the back of rear body part. The liquid aspirated by suction of vacuum cleaner is discharged to the rear of assembled unit. The filter cartridge slows air and water speed down and distributes liquid to front liquid reservoir, where at a predetermined level floats are activated to cut off air flow, thus stopping liquid flow before penetrating hose of vacuum cleaner preventing moisture damage. Front and rear said body parts may be separated easily to empty apparatus thus resetting floats enabling the apparatus to perform again.

19 Claims, 8 Drawing Figures

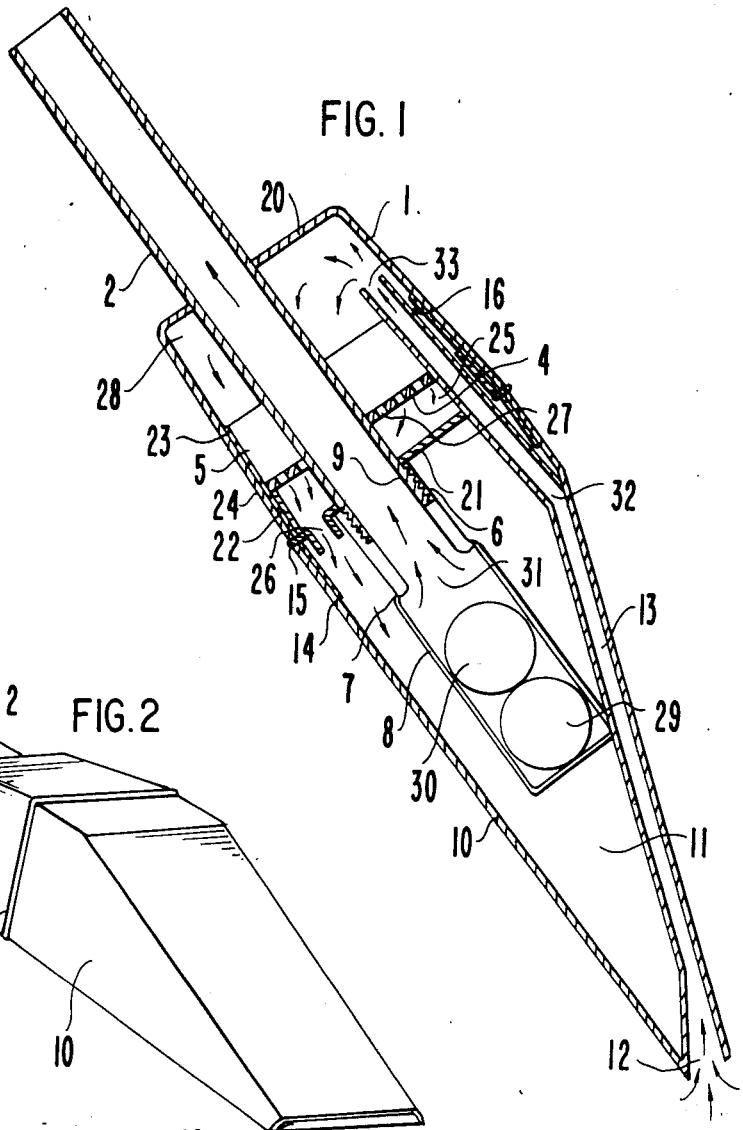
FIG. 1
20
1
33
16
25
4
27
2
28
23
5
9
21
32
24
6
22
31
26
15
13
14
7
29
8
30
10
11
12
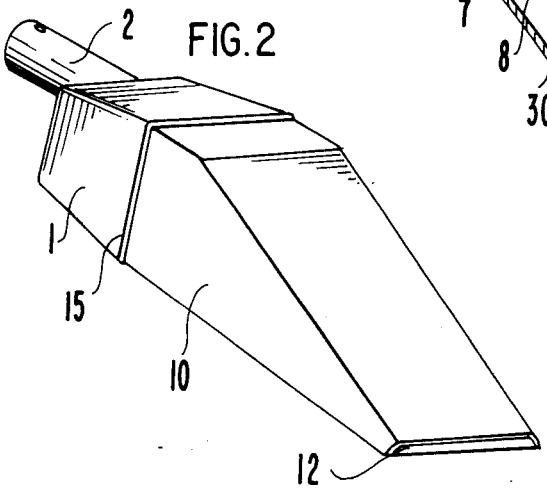
FIG. 2
2
1
15
10
12
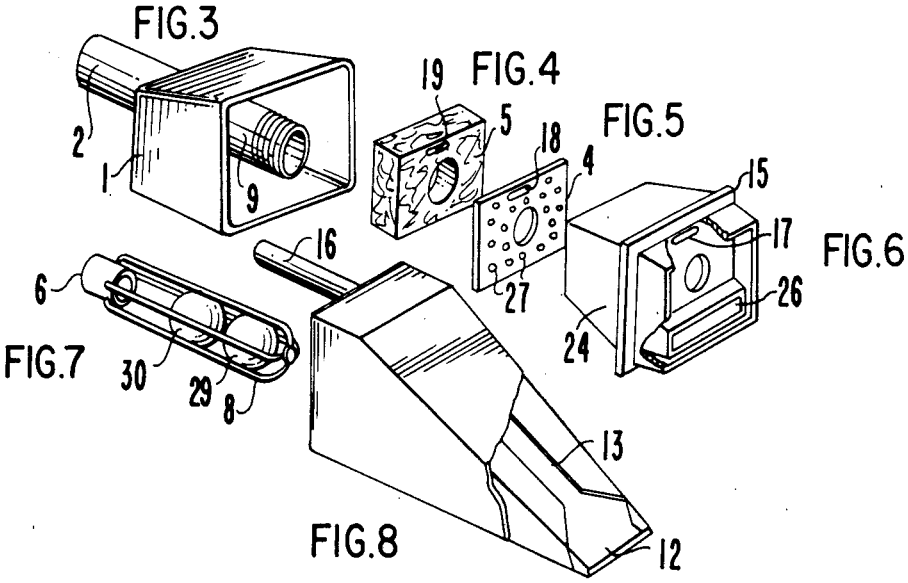
FIG. 3
2
1
9
FIG. 4
19
5
FIG. 5
18
4
15
17
FIG. 6
26
27
24
16
6
FIG. 7
30
29
8
13
FIG. 8
12

LIQUID ASPIRATOR VACUUM ATTACHMENT

This invention relates to a liquid aspirator which attaches to standard vacuum cleaner hoses preventing water damage to said vacuum cleaner motor.

Liquid may be extracted from carpets and floors by many apparatuses which may be connected to standard vacuum hoses or are self-contained larger units. All of the apparatuses used are designed for large amounts of liquid and are constructed so that liquid aspirated is discharged into large reservoirs. The large reservoirs thus make it necessary to concentrate filters and baffles inside of reservoir or in front of shut-off valves.

These devices entail many major inconveniences in that besides all being large and awkward to use, if the devices are accidently tipped over or laid on the floor while electric motor of vacuum is still running, liquid may be drawn passed the cut off valves and into the electric motors. If detergents are also picked up with liquid, suds created inside the reservoir do not allow the floats, designed to stop air flow, to activate, thus danger of electric shock may occur. When these devices are laid on floor or tipped over while suction of cleaner is terminated, liquid may also run back out of nozzles onto floor creating an inconvenience.

I have discovered methods in which these inconveniences may be overcome and allows a small, compact, lightweight unit which attaches conveniently to any vacuum hose.

I have found that these disadvantages may be overcome by constructing the device much smaller than any other and allowing said device to pick up smaller quantities at any one time. The liquid aspirated is discharged to the rear of the device where a cartridge containing a filter as well as a retainer plate slows down the air speed being the major cause of liquids splashing inside the main reservoir. The liquid once drawn through the filter and retaining plate enters a chamber which stabilizes the liquid and discharges said liquid slowly and steadily into front reservoir thus eliminating splash. When said liquid enters into front reservoir to a predetermined level, floats are activated to cut off air flow. To eliminate any possibility of liquids being drawn past the cut-off valves when unit is laid down or tipped upside down while motor of vacuum is still operating, the tube protruding through the rear body part, filter, retaining plate and cartridge wall, extends into the front reservoir far enough that the maximum capacity of liquid allowed to the reservoir cannot flow over the valve seal at any angle.

In drawings which illustrate embodiments of invention,

FIG. 1 is a cross-section of the complete unit assembled,

FIG. 2 is a three dimensional view of device assembled showing external front and rear body parts, FIG. 3 is a three dimensional view of the rear body part, FIG. 4 is a three dimensional view of the filter, FIG. 5 is a three dimensional view of the retainer plate, FIG. 6 is a three dimensional view partly in section of the filter cartridge, FIG. 7 is a three dimensional view of the valve seal and cage containing two ball floats, FIG. 8 is a three dimensional view partly in section of the front body part.

In the attached drawings the liquid aspirator consists of a rear body part 1 from which a protruding end piece 2 fastens to a conventional vacuum cleaner hose (not shown) and acts as a handle. A cartridge 3 (shown in embodiment FIG. 6), contains inside of said cartridge a retainer plate 4 (shown in embodiment FIG. 5), a filter made of pourous material 5 (shown in embodiment FIG. 4). The cartridge 3 is secured into rear body part 1 by threaded extension 6 which also comprises rubber cut-off seal 7 as well as float cage 8 all molded into one unit (shown in embodiment FIG. 7). The said threaded extension 6 is fastened to end of main airflow tube 9 after cartridge is inserted into rear body part 1. The front body part 10 which consists of water reservoir 11 front nozzle 12 and liquid traverse tube 13 all molded into one unit (see FIG. 8) fastens to rear body part 1 by sliding onto front extension lip 14 of cartridge 3. A rubber seal 15 moulded directly to cartridge 3 creates water tight seal between rear body part 1 and front body part 10. During assembly the extension pipe 16 of liquid traverse tube 13 which is connected directly to front body part 10, slides through opening 17 on cartridge 3 opening 18 on retainer plate 4 and opening 19 in filter 5. The extension pipe 16 does not touch the back wall 20 of rear body part 1. Retainer plate 4 is held apart from inside wall 21 of cartridge 3 by small spacers 22 molded into inner walls 23 of inside lip 24 of cartridge 3 thus creating air compartment 25. During operation a vacuum is created by a conventional vacuum cleaner. Said vacuum cleaners hose connecting to extension tube 2. A vacuum is then created in liquid reservoir 11. Air is then drawn through opening 26 on filter cartridge 3 creating vacuum in air chamber 25. Air is then drawn through openings 27 in retainer plate 4 and proceeds to draw air through filter 5 creating vacuum in rear air compartment 28 of rear body unit 1 drawing air and liquid through traverse tube 13 from end nozzle 12 of front body part 10. Liquid enters air chamber 28 at high speed and is slowed down by filter 5. Liquid is then discharged through openings 27 evenly across area of retainer plate 4 and at a slow speed into air chamber 25 which in turn stabilizes any splash and funnels water at a slow speed through opening 26 of cartridge 3 into reservoir 11. Retainer plate 4 also serves the purpose of holding filter 5 back from being drawn into opening 21 of cartridge 3. As the liquid in reservoir 11 fills up, the ball float 29 pushes ball float 30 toward rubber seal 7 ball float 29 serves the purpose of providing sufficient distance between water level and rubber seal 7 so as no droplets of liquid are drawn through opening 31 from air speed or air turbulence. When liquid reaches a predetermined point ball float 30 seals up opening 31 by sealing space between ball float 30 and rubber seal 7. Ball float 30 and 29 are guided into position by float cage 8. The volume of compartment 11 is such that the maximum volume of liquid which can be aspirated when the device is in a vertical position is less than the volume of liquid required to rise above the rubber seal 7 and enter opening 31 when the device is in a horizontal or inverted position. The volume of liquid flows around an axis point being at the mouth of opening 31. The traverse tube 13 also serves the purpose in that when the device is put on the ground upside down or at any angle and suction is terminated by switching of the vacuum, liquid may not escape back out the nozzle 12 because of angle 32 which demands the liquid to stay in compartment 28 by gravity. Should the device be laid on its side or any other angle the opening 33 of traverse pipe 13 is in such a position that liquid cannot enter.

The embodiments of the invention in which an exclusive property or privilege is claimed are defined as follows:

1. A liquid aspirator comprising:

walls defining a body having an interior space, attachment means on said body for attaching a vacuum to said body to draw a vacuum within the interior space, a wall within said body dividing said body into an air compartment and a water reservoir within said body, said vacuum attachment means including a tube extending into said water reservoir;

walls in said body defining a front nozzle on said body, said walls also defining a traverse tube extending from said front nozzle to said air compartment within said body, said tube extending into said water reservoir having an opening into said water reservoir so that said tube may draw a vacuum on said water reservoir, said opening in said tube being positioned and said body being so shaped that there is less volume below said opening when said front nozzle is directed in a gravitationally downward direction as compared to any other direction.

2. The liquid aspirator of claim 1 wherein said wall separating said body includes a filter to separate particulate matter from a stream of material vacuumed through said front nozzle and said traverse tube into said air compartment before the stream passes into said water reservoir.

3. The liquid aspirator of claim 2 wherein said filter rests against a perforate plate extending adjacent said inside wall which separates said air compartment from said water reservoir.

4. The liquid aspirator of claim 3 wherein said body is formed as a rear body part and a front body part, which are separable from each other, said rear body part and said front body part being attached by means of a cartridge which fits within both of said body parts and seals to both said body parts.

5. The liquid aspirator of claim 4 wherein said tube extends through said cartridge.

6. The liquid aspirator of claim 5 wherein there is a float valve adjacent said opening in said tube so that when water rises in said reservoir adjacent said opening in said tube, said float valves closes said opening.

7. The liquid aspirator of claim 6 wherein said float valve comprises a ball which floats in water, said ball being positioned within a cage within said water reservoir adjacent said opening in said tube so that said ball is constrained to float into a position where it closes said opening when water rises to float said ball.

8. The liquid aspirator of claim 1 wherein there is a float valve adjacent said opening in said tube so that when water rises in said reservoir adjacent said opening in said tube, said float valves closes said opening.

9. The liquid aspirator of claim 8 wherein said float valve comprises a ball which floats in water, said ball being positioned within a cage within said water reservoir adjacent said opening in said tube so that said ball is constrained to float into a position where it closes said opening when water rises to float said ball.

10. A liquid aspirator comprising:

walls defining a body including a wall across the interior of said body to define an air compartment within said body and a water reservoir within said body, said walls defining an exterior front nozzle on the water reservoir end of said body and a liquid traverse tube extending from said front nozzle to said air compartment within said body;

vacuum attachment means including a tube extending into said water reservoir adjacent said wall dividing said body for attachment to a vacuum source for drawing a vacuum in said water reservoir; and a filter positioned between said air compartment and said water reservoir to filter particulate matter out of stream flow drawn by the vacuum into said front nozzle and through said traverse tube into said air compartment.

11. The liquid aspirator of claim 10 wherein said body is formed of separable front and rear body portions and there is a cartridge joining and sealing to both of said body portions to separably retain together said body portions.

12. The liquid aspirator of claim 11 wherein said cartridge includes said filter.

13. The liquid aspirator of claim 12 wherein said cartridge includes a perforated retainer plate and said filter lies against said retainer plate so that said retainer plate inhibits motion of said filter toward said liquid reservoir.

14. The liquid aspirator of claim 13 wherein the opening in said vacuum tube in said water reservoir is positioned and said walls defining said water reservoir are shaped so that there is less volume in said water reservoir below said opening when said front nozzle is gravitationally below said opening than when said front nozzle is above said opening.

15. The liquid aspirator of claim 14 wherein there is a float valve positioned adjacent said opening so that when water rises to a position adjacent said opening, said float valve closes said opening.

16. The liquid aspirator of claim 15 wherein said float valve is a ball of such density as to float on water and there is a cage positioned around said ball so that when water rises within said water reservoir, said ball is constrained by said cage to float to close said opening.

17. The liquid aspirator of claim 10 wherein the opening in said vacuum tube in said water reservoir is positioned and said walls defining said water reservoir are shaped so that there is less volume in said water reservoir below said opening when said front nozzle is gravitationally below said opening than when said front nozzle is above said opening.

18. The liquid aspirator of claim 17 wherein there is a float valve positioned adjacent said opening so that when water rises to a position adjacent said opening, said float valve closes said opening.

19. The liquid aspirator of claim 18 wherein said float valve is a ball of such density as to float on water and there is a cage positioned around said ball so that when water rises within said water reservoir, said ball is constrained by said cage to float to close said opening.

* * * * *